United States Patent [19]

Boisseau

[11] Patent Number: 5,024,641

[45] Date of Patent: Jun. 18, 1991

[54] PROGRAMMABLE DYNAMICALLY ADJUSTABLE PLUNGER AND TRAY FORMER APPARATUS

[75] Inventor: Jean-Louis Boisseau, Courgerennes, France

[73] Assignee: Vega Automation, France

[21] Appl. No.: 561,331

[22] Filed: Aug. 1, 1990

Related U.S. Application Data

[62] Division of Ser. No. 274,054, Oct. 7, 1988, Pat. No. 4,988,331.

[51] Int. Cl.[5] ..... B31B 3/44; B31B 3/46

[52] U.S. Cl. ..... 493/171; 493/143; 493/167; 493/474

[58] Field of Search ..... 493/143, 167, 171, 474, 493/475, 476

[56] References Cited

U.S. PATENT DOCUMENTS 2,826,127 3/1958 Straw ..... 493/171

3,218,940 11/1965 Pearson ..... 493/130

4,345,905 8/1982 Moen ..... 493/171

*Primary Examiner*—William E. Terrell

*Attorney, Agent, or Firm*—Mason, Fenwick & Lawrence

[57] ABSTRACT

A progammable, dynamically adjustable die stamping apparatus for die-stamping of cardboard blanks used in production of packaging trays is disclosed. The apparatus includes a dimensionally adjsutable die having a plurality of separate movable parts each coupled to threaded adjustment rods and drive motors; a programmable control is coupled to the drive equipment and can selectively adjust and lock the die parts to conform the die to any one of a plurality of cardboard blank formats. Plural air-operated lockable jacks coupled to movable members of a stamp are also provided, and the jacks operate to automatically adjust the stamp to conform to the selected dimensions of the die. The apparatus can accept plural magazines of cardboard blanks and a plurality of different blanks supplied successively; under program control, the apparatus can automatically change the dimensions of the die and stamp to conform to the desired dimensions of the finished tray.

5 Claims, 9 Drawing Sheets

PROGRAMMABLE DYNAMICALLY ADJUSTABLE PLUNGER AND TRAY FORMER APPARATUS

This application is a division of U.S. patent application Ser. No. 274,054, filed Oct. 7, 1988, U.S. Pat. No. 4,988,331.

FIELD OF THE INVENTION

The present invention relates to a process for dynamic dimensional adjustment of a stamping assembly for the die-stamping of cardboard blanks used in the production of packaging trays, and relates to a die-stamping apparatus for carrying out this process.

BACKGROUND OF THE INVENTION

There is already a known process for die-stamping blanks using a stamp/die assembly. Using such prior art processes, blanks to be die-stamped is extracted successively from blank supply means, such as a magazine; the blank is transferred between the stamp and the die spaced apart; the stamp and the die are brought closer, until they contact either side of the blank to die-stamp it; if appropriate, matching or mutually adjacent parts of the blank are fastened together, by adhesive bonding; the stamp and the die are moved apart; and the blank is extracted and discharged.

A blank die-stamping device which can be used on a packaging machine, such as a tray-making machine, is likewise known and comprises a stamp and a die interacting with one another, means for bringing the stamp and the die closer and for spacing them apart between two end positions. These positions include an inactive position, in which they are spaced apart, and an actual die-stamping position, in which they are fitted one in the other, and means for extracting and for discharging the die-stamped blanks.

Reference can be made, for example, to the document FR No. 2,248,932.

This die-stamping process and device are intended for a packaging machine possessing means for supplying blanks, means for extracting a blank from these supply means, means for transferring this blank to the die-stamping device, means for extracting the die-stamped blank from the die-stamping device and for discharging it towards another station for filling it with contents to be packaged.

Such prior art die-stamping processes and device are usually designed to operate with a single format of blanks. The blanks are generally made of cardboard, having folding lines and matching or mutually adjacent parts intended to be fastened together by adhesive bonding (tabs, flaps, etc). In fact, the best known packaging machines associated with such die-stamping devices generally operate under a single blank format. Achieving a change in blank format is therefore either impossible or is carried out by changing the stamp and the die completely or manually, this being lengthy, difficult, inaccurate, costly, etc.

The document U.S. Pat. No. 3,218,940 describes a cardboard-shaping machine which possesses such a die-stamping device adjustable manually so as to be adapted to cardboard blanks of different formats. For this purpose, the stamp and the die are each made of several plural shiftable, but lockable relative in the two longitudinal and transverse directions, to means for guiding and driving these parts ensuring these shifts and locks. However, these shifts and locks are manual and, moreover, separate and distinct for the stamp and the die, thus making it impossible, in practice, to carry out numerous rapid, easy and reproducible adjustments.

Other devices are also known from the documents U.S. Pat. Nos. 2,641,973, 2,798,416, DE No. 292,080, U.S. Pat. Nos. 3,046,849, 1,386,292, 4,033,242 and 3,357,700.

In the general sector of packaging, it is also known that there is the possibility of adjusting the members of a machine, depending on the conditions of use, including the dimensions of the processed packages (see the documents FR No. 2,029,300 and EP No. 0,142,007). However, such adjustments are not suitable for the die-stamping of blanks.

The first object of the present invention is, therefore, to provide a method and apparatus for programmable automatic control of die and stamp size in a die-stamping assembly, each die-stamping member of which is in several adjustable and lockable parts. More specifically, the object of the invention is to ensure automatic, rapid, accurate and reproducible adjustment. The second main object of the invention is to carry out such an adjustment in machinery adapted for use in packaging is concerned.

For this purpose, the invention provides a process for the dimensional adjustment of a die-stamping assembly comprising two die-stamping members, a stamp and a die, each composed of several plural parts having relative positions adjustable and lockable as a result of lateral position changes, the two die-stamping members being moveable after axial engaging/disengaging shifts. The two die-stamping members being, each separately, either locked or unlocked and, together, either engaged or disengaged to adapt the die-stamping assembly dimensionally to a blank format to be die-stamped and bring it into a stand-by position, from which the die-stamping of the blank is made possible after the subsequent interaction of the two die-stamping members, this stand-by position being such that the two die-stamping members are disengaged, locked and with lateral die-stamping spacings between their corresponding component parts adapted to the thickness of the blank, wherein the two die-stamping members are first unlocked, the appropriate transverse position changes are subsequently executed, and finally the two die-stamping members are locked, said process being defined in that the following steps are carried out: in a zero calibration step, the two die-stamping members are first brought from their disengaged state into their engaged and unlocked state, with their corresponding component parts in contact, after configurational and engaging/disengaging shifts, and in a predetermined reference configuration; subsequently, in an initial adjustment step, action is taken on only one of the two die-stamping members, the driving adjustment member, to ensure its position change, the driving adjustment member in turn acting directly on the other die-stamping member, the driven adjustment member, to ensure its position change in synchronism, until a first die-stamping member has been adjusted dimensionally; and thereafter, the first die-stamping member is locked; in a second adjustment step, action is taken on only the second die-stamping member, to ensure its position change in the direction of a lateral spacing apart from the first die-stamping member, until the lateral die-stamping spacings are reached, the second die-stamping member then being adjusted dimensionally; the second die-stamping member is locked; and an engaging/disengaging shift of the two die-stamping members is executed to bring them into the stand-by position, the effect of this being to ensure automatic, rapid, accurate and reproducible adjustment of the die-stamping assembly.

The invention subsequently provides a blank die-stamping assembly comprising two die-stamping members, a stamp and a die, each in several plural having relative positions adjustable and lockable after lateral position changes by lateral driving and locking means, the two die-stamping members being moveable relative after axial engaging/disengaging shifts by axial driving and locking means, the two die-stamping members being movable, each separately, either locked or unlocked and, together, either engaged or disengaged, to dimensionally adjust the die-stamping assembly which, can be in a stand-by position, in which the die-stamping members are disengaged, locked and with a preset space between their corresponding component parts, and in a die-stamping position, in which the die-stamping members are engaged and interact for the effective die-stamping of a blank placed between them, wherein the lateral means for driving and locking the two die-stamping members are shared by the two die-stamping members and comprise, positive two-way drive means lockable in any position, coupled to and acting directly on one of the two die-stamping members, the driving member, and, single-direction actuator lockable in any position, coupled to and acting directly on the other die-stamping member, the driven member, such that, when the single-direction actuators are unlocked, these means act on the driven member so as to urge it into contact with the driving member, the two die-stamping members being engaged, and in the second place the two-way drive means drive the driven member indirectly via the driving member.

Finally, the invention provides, a process for the die-stamping of blanks and, a die-stamping machine putting into practice this adjustment process and this die-stamping assembly, which are intended for packaging.

One of the technical arrangements ensuring that the adjustment of the die-stamping assembly is automatic, rapid, accurate and reproducible is the use of adjustment means which are mechanized and can therefore be controlled and which act directly only on one of the two die-stamping members to shift it, the so-called driving member, the latter in turn ensuring the shift for the other die-stamping member, the so-called driven member. For this purpose, single acting jacks act on the driven member to urge it into contact with the driving member. Also, adjustment is carried out when the two die-stamping members are engaged one in the other. Preferably, the driving member is the die which can thus surround the stamp subjected elastically to compressed-air jacks in the direction of expansion. Threaded drive rods ensure the lateral position changes of the die and allow the position of the latter to be marked. To make it possible to ensure reproducibility, there is preferably an initial step involving the zero calibration of the two die-stamping members at a zero point corresponding to an extreme, minimum format.

The other characteristics and advantages of the invention will emerge from the following description, with reference to the accompanying drawings in which.

DETAILED DESCRIPTION OF PREFERRED EMBODIMENT

Figure 1:
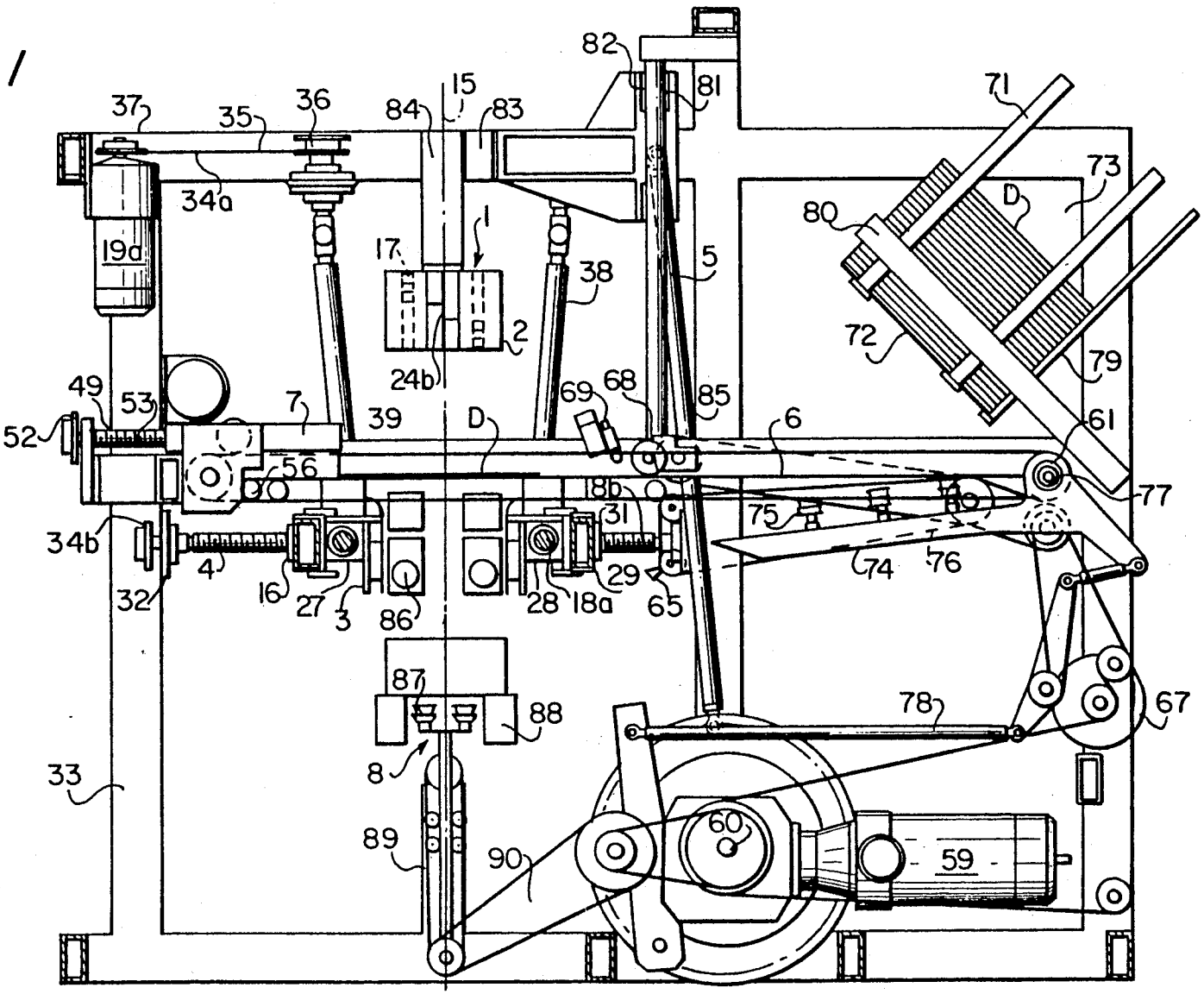
FIG. 1 is an elevation view of a die-stamping machine according to the invention.
Figure 2:
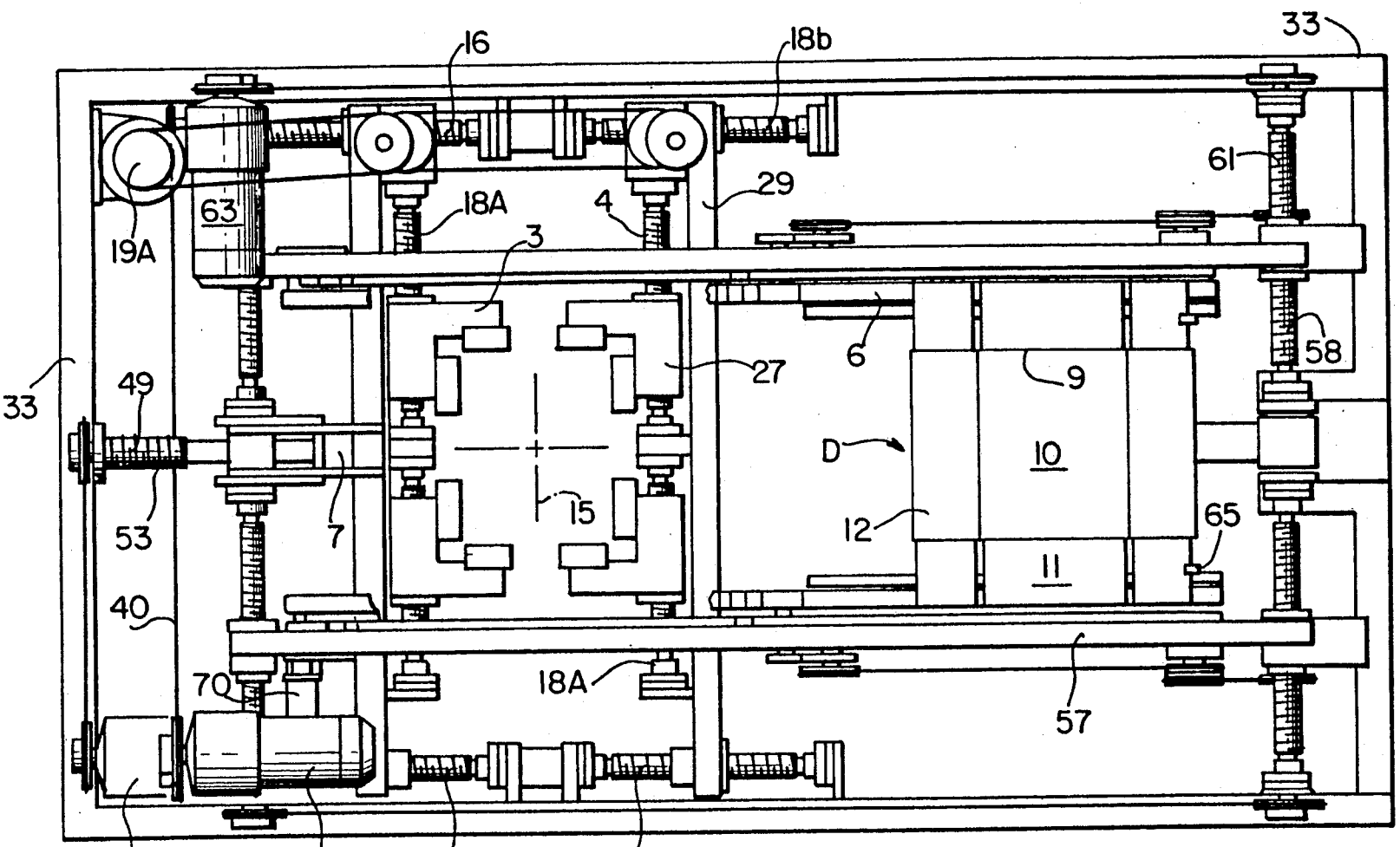
FIG. 2 is a partial plan view of the die-stamping maching according to the invention, the stamp not being shown.
Figure 3:
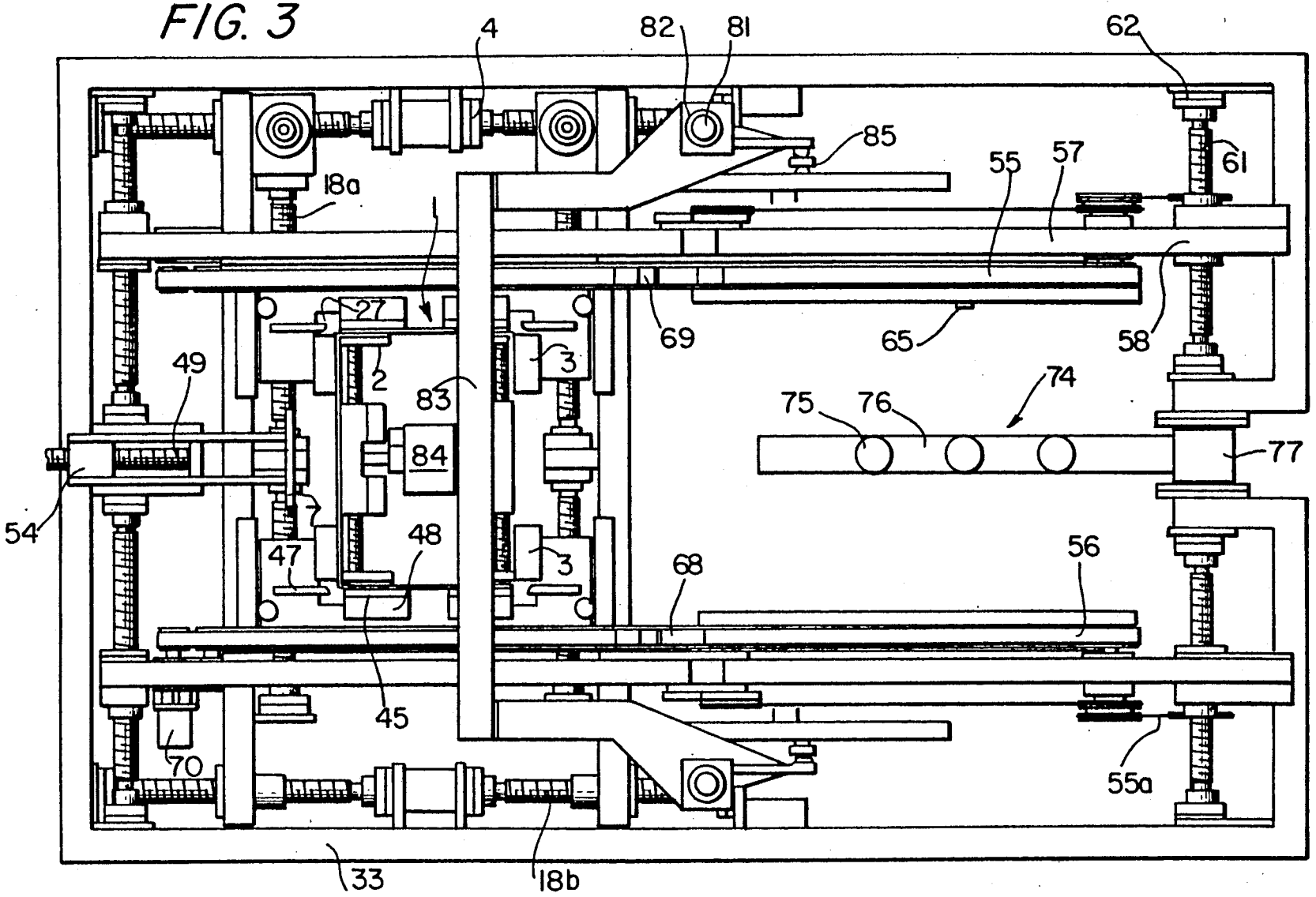
FIG. 3 is a plan view of the die-stamping machine according to the invention on a larger scale, the die-stamping assembly being shown with a blank during die-stamping.

The assembly 1 comprises, in a way known per se, two die-stamping members, a stamp 2 and a die 3, each in several plural having relative positions adjustable and lockable after lateral position changes by lateral driving and locking means 4. The two die-stamping members 2, 3 are moveable relative after axial driving and locking shifts by axial driving and locking means 5. The two die-stamping members 2, 3 are, each separately, either locked or unlocked and, together, either engaged or disengaged. Such a die-assembly 1 can be adapted dimensionally to a given blank format to be die-stamped and, can be in a stand-by position, in which the die-stamping members 2, 3 are disengaged, locked and with a preset space between their corresponding component parts, and in a die-stamping position, in which the die-stamping members 2, 3 are engaged from the stand-by position and interact for the effective die-stamping of a blank placed between them.

A process for the dimensional adjustment of such a assembly 1 is such that, in a way known in the prior art, the two die-stamping members 2, 3 are first unlocked, the appropriate lateral position changes are subsequently executed, and finally the two die-stamping members 2, 3 are locked.

Such a assembly 1 can be incorporated in a blank die-stamping machine intended for the production of packaging trays, and which possesses, in addition to the assembly 1, blank supply means 6, means forming a longitudinal abutment 7 which are coupled to the supply means 6 and which are capable of locking the blank D to be die-stamped in the appropriate position for its die-stamping by the assembly 1, and means 8 for the extraction and discharge of a die-stamped blank D.

Figure 4:
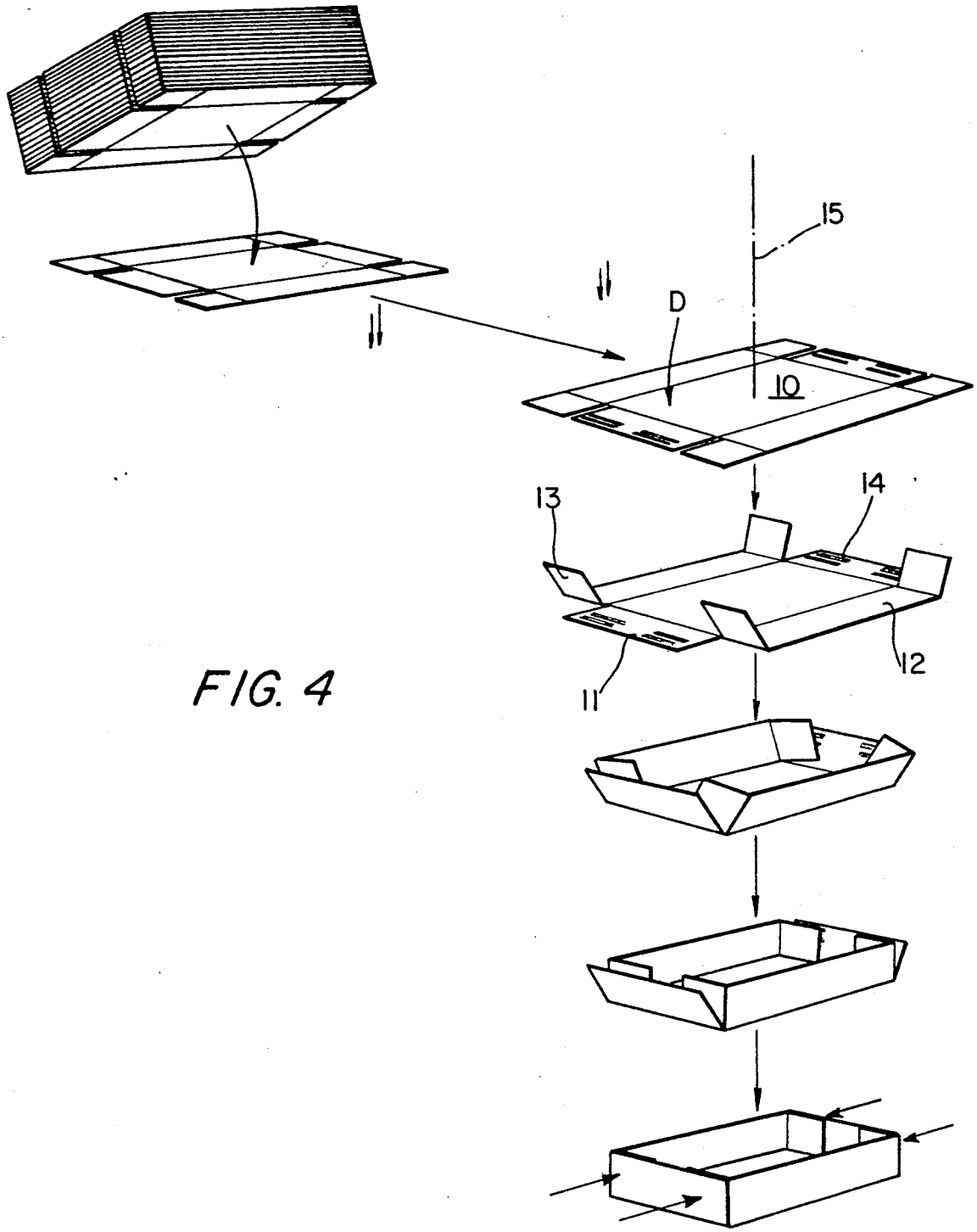
FIG. 4 is a diagram illustrating the steps in the die-stamping of the blank.
Figure 5:
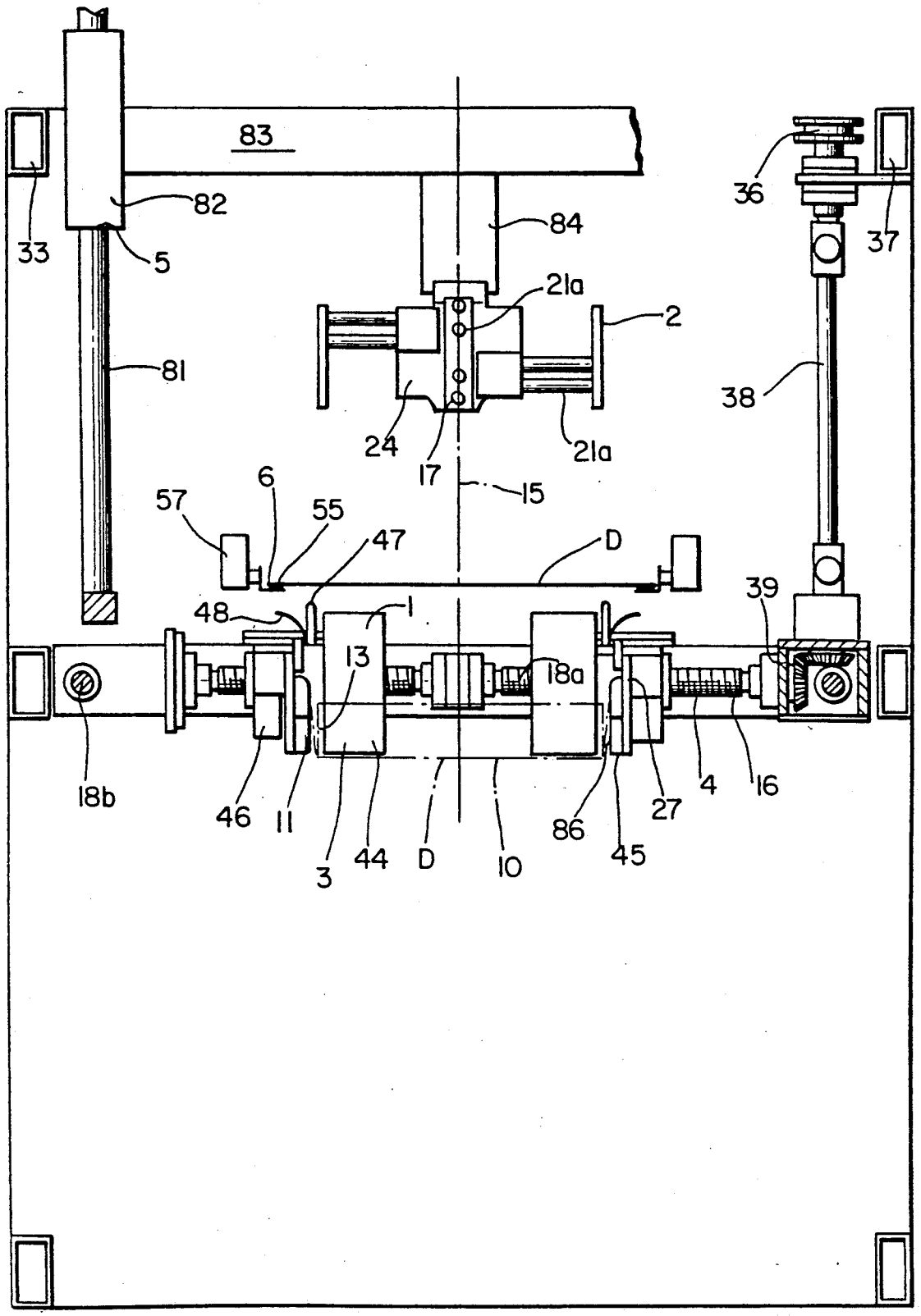
FIG. 5 is a sectional view in a transverse vertical plane, illustrating the die-stamping assembly.

The blanks D used are not themselves the subject of the invention. They take the form of originally flat blanks made of cardboard or the equivalent, having (FIG. 4) folding lines 9 and matching or correspondingly adjacent parts intended to be fixed together, after adhesive bonding, for maintaining their volume. After the die-stamping, such blanks D are given a volume, preserve the volume given to them and can subsequently receive contents to be packaged. In a conventional embodiment, the blank D originally has a general planar rectangular form comprising a central bottom 10 and, on each of its sides forming a folding line 9, a flap intended to be placed perpendicularly relative to the bottom 10 and upwards, once the blank has been given a volume. These flaps are two longitudinal flaps 11 and two transverse flaps 12. Two opposite flaps, for example the transverse flaps 12, are extended, at each of their end edges forming a folding line 9, by a short tab 13 intended, once the blank D has been put into shape, to be adhesively bonded to the adjacent longitudinal flap 11 on its inner face using strips of glue 14.

Such a blank D can be multi-format, the bottom 10 having a form which is rectangular or more or less square or flattened in elevation and more or less variable absolute and relative (in relation) dimensions.

The invention applies, however, to other general forms of blanks: triangular, polygonal, cylindrical, etc. Furthermore, these blanks can be intended for uses other than a tray.

The same die-stamping assembly 1, after adjustment, can be used for different blanks D, either of the same general form, but of different dimensions or even of different forms. Preferably, the invention is used for blanks D which have the same general from (for example, rectangular) and only the dimensions of which change.

The invention is described more with regard to blanks D having a general rectangular or square form, that is to say included in an envelope of general parallelipedic form, once given a volume, the changed dimensions being the length and width of the bottom 10 and the width of the flaps 11, 12.

Such blanks D are well known to a person skilled in the art of packaging, and for this reason they are not described in more detail. Likewise, the general structures of a die-stamping assembly and of a die-stamping machine possessing such a die-stamping assembly, as has just been described, are well known to a person skilled in the relevant art, and for this reason they need not be described in more detail. The description therefore relates, above all, to the essential means of the invention aimed at ensuring automatic, rapid, accurate and reproducible adjustment of the assembly 1, so that it is possible for blanks of different formats to be die-stamped in a flexible and automatic way.

A machine carrying a die-stamping assembly 1, according to the invention, is constructed such that the blanks to be die-stamped are delivered in units linearly one after the other, the blanks D being arranged horizontally, up to a die-stamping position, in which a blank remains stationary to be die-stamped by the assembly 1, the stamp 2 interacting with the die 3. More specifically, the blank D to be die-stamped is brought exactly above the die 3, while the stamp 2 is spaced apart vertically in line with and above the die 3, the axis 15 of the assembly 1 being vertical. Then, with the die 3 remaining stationary, the stamp 2 is slid vertically downwards along the axis 15 to come in contact with the blank D to be die-stamped and shape it in interaction with the die 3. Subsequently, once this die-stamping has been carried out, the stamp 2 is separated from the die 3, and the die-stamped blank can be released from the assembly 1 to be discharged by the extraction and discharge means 8.

Such a die-stamping is generally carried out for series of several uniform blanks of the same format. In this case, there is no need to carry out the dimensional adjustment of the assembly 1 between each blank. When, after the die-stamping of such a series of blanks of a particular format, the format of blanks to be die-stamped is to be changed, the dimensional adjustment of the assembly 1 is then carried out, as described herein. However, since the dimensional adjustment of the assembly 1 is automatic, rapid, accurate and reproducible, it is possible to have completely flexible die-stamping, successive blanks D to be die-stamped arriving in units according to formats different.

In general terms, the stamp 2 takes the form of a rigid (but deformable) piece having a plurality of projecting angles adjacent horizontally called reentry angles for forming the cardboard blank. The die is also a rigid, but deformable piece having the same plurality of reentry angles. The projecting angles of the stamp 2 interact with the reentry angles of the die 3, that is to say the projecting angles are placed inside the re-entry angles, being set apart laterally by the amount of a lateral die-stamping spacing depending on the thickness of the blank D to be die-stamped.

The stamp 2 and the die 3 are each constructed in plural, these parts each constituting all or part of a respectively projecting or reentry angle. These component parts of the stamp 2 or of the die 3 have a relative position which to allow the dimensional adjustment of the assembly 1. The locking of the component parts of the stamp 2 and of the die 3 in any desired relative adjustment position makes it possible to give the stamp 2 and the die 3 the rigidity necessary for its operation.

By convention, the relative shifts of the component parts of the stamp 2 or of the die 3 respectively are called lateral position changes. In fact, these shifts are executed in the lateral directions of the stamp 2 or of the die 3 (that is to say, in the direction of contraction or in the direction of expansion in relation to the axis 15), and their purpose is to change the configuration of the stamp 2 and of the die 3 to give it a suitable dimension.

The stamp 2 and the die 3 are moveable relative in a given configuration along the axis 15 after axial engaging/disengaging shifts. Preferably, the die 3 remains stationary and only the stamp 2 is moveable by sliding along the axis 15.

This text uses the expression "die-stamping member" to denote either the stamp 2 or the die 3.

As emerges from the foregoing, the component parts of each die-stamping member 2 and 3 can be in a certain relative position corresponding to a certain configuration of the die-stamping member which then forms a rigid assembly suitable for die-stamping. This state, in which the component parts of each die-stamping member 2 and 3 are locked in terms of their relative shifting, is called the locked state. Conversely, to allow the change of configuration of a die-stamping member 2 and 3 after lateral position changes, such shifts are permitted by unlocking these components parts of each die-stamping member. This corresponds to the unlocked state. Die-stamping takes place locked, and the unlocked state is only a temporary state allowing the dimensional adjustment of the die-stamping members 2, 3. Since the two die-stamping members 2, 3 are structurally separate, one of them can be in the locked (or unlocked) state, while the other is in the locked or unlocked state.

Moreover, the die-stamping members 2, 3 taken, can be in several positions. In one of these relative positions, the stamp 2 is seated in the die 3, and the stamp 2 and the die 3 are then substantially at the same location along the axis 15. In this case, the assembly 1 is said to be. This engaged state corresponds to a lower end position of the stamp 2. Conversely, when the stamp 2 is spaced apart from the die 3 along the axis 15, thus being released outside the die 3, the assembly 1 is said to be disengaged. Each die-stamping member 2 and 3 is locked or unlocked, depending on whether the assembly 1 is engaged or disengaged.

The dimensional adjustment of the die-stamping assembly is carried out when the stamp 2 is in the die 3, i.e. engaged. From then on, the unlocked state occurs only when the apparatus is engaged. And in some steps of the process and when the assembly 1 is engaged, either one or both of the die-stamping members 2, 3 are locked. Engaged, the die-stamping members 2, 3 can have several possible relative configurations. In one of these possible relative configurations, there is a desired a preset space between the stamp 2 and the die 3. In this case, the assembly 1 is said to be in the die-stamping position. Other positions are possible when the apparatus is engaged that in which the stamp 2 and the die 3 are in contact without any lateral spacing between them.

Furthermore, the die-assembly 1 can be in a standby position, in which the two die-stamping members 2, 3 are disengaged, locked and with a preset space between their corresponding component parts and are therefore adapted to the thickness of the blank. This stand-by position (FIG. 1) is that in which the stamp 2 is removed from the die 3, being spaced axially apart from the latter, the dimensional adjustment of the stamp 2 and of the die 3 being executed and allowing subsequent die-stamping for a blank of suitable format. This stand-by position is generally that in which the stamp 2 is in its upper end position.

In the text, the direction of delivery of the blanks D to be die-stamped is referred to as longitudinal. This direction is generally horizontal. The horizontal direction perpendicular to the longitudinal direction is referred to as transverse. The longitudinal and transverse directions thus define a horizontal plane and the two directions in which the dimensional adjustment of the die-stamping assembly is to be carried out.

Figure 10B:
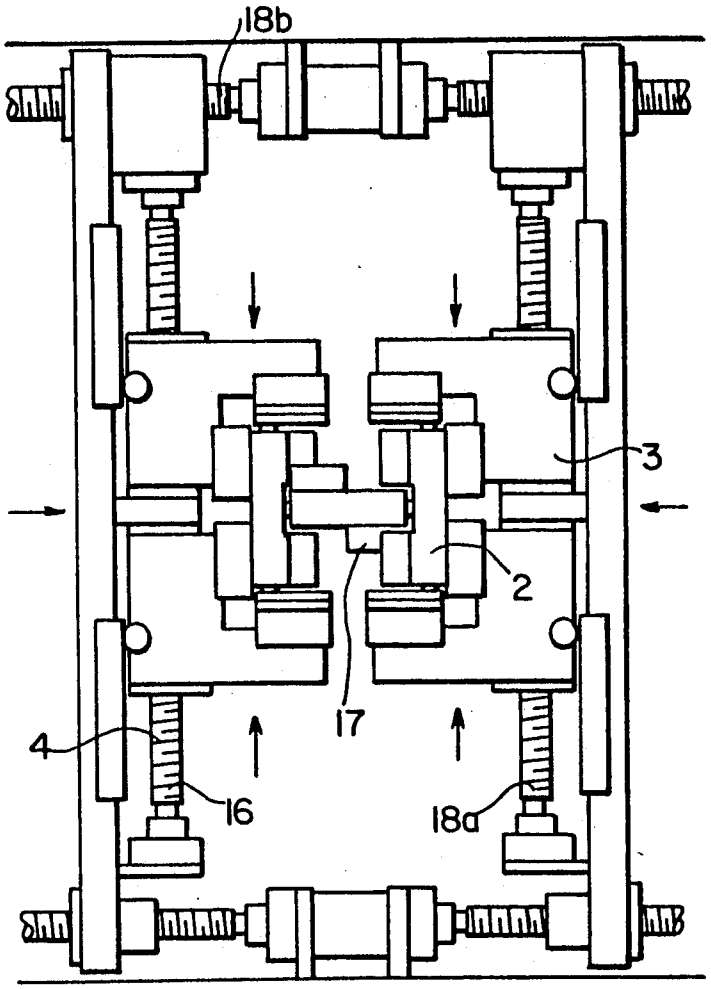
FIG. 10A, 10B, 10C and 10D are four diagrammatic plan views illustrating successive steps in the adjustment of the die-stamping assembly according to the inventive method.

In the adjustment process according to the invention, the following steps are executed: in a zero calibration step, the two die-stamping members are first brought from their disengaged state into their engaged and unlocked state, their corresponding component parts in contact, after configurational and engaging disengaging shifts and in a predetermined reference configuration (as shown in FIG. 10B).

Figure 10A:
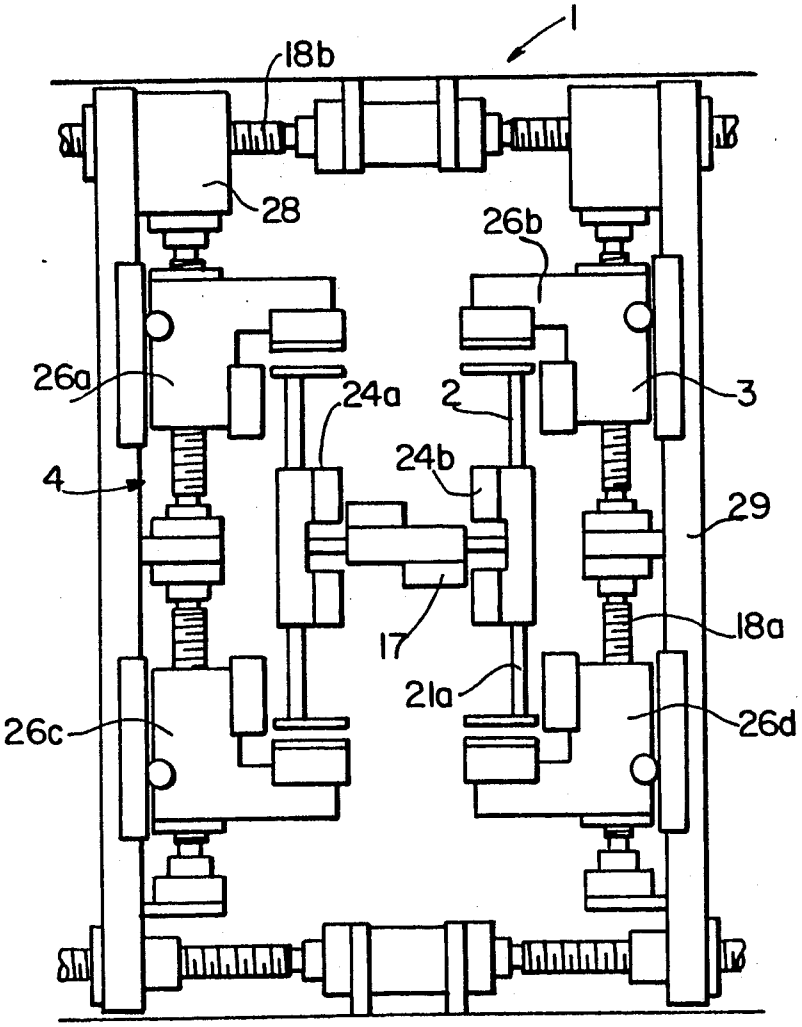
Figure 10D:
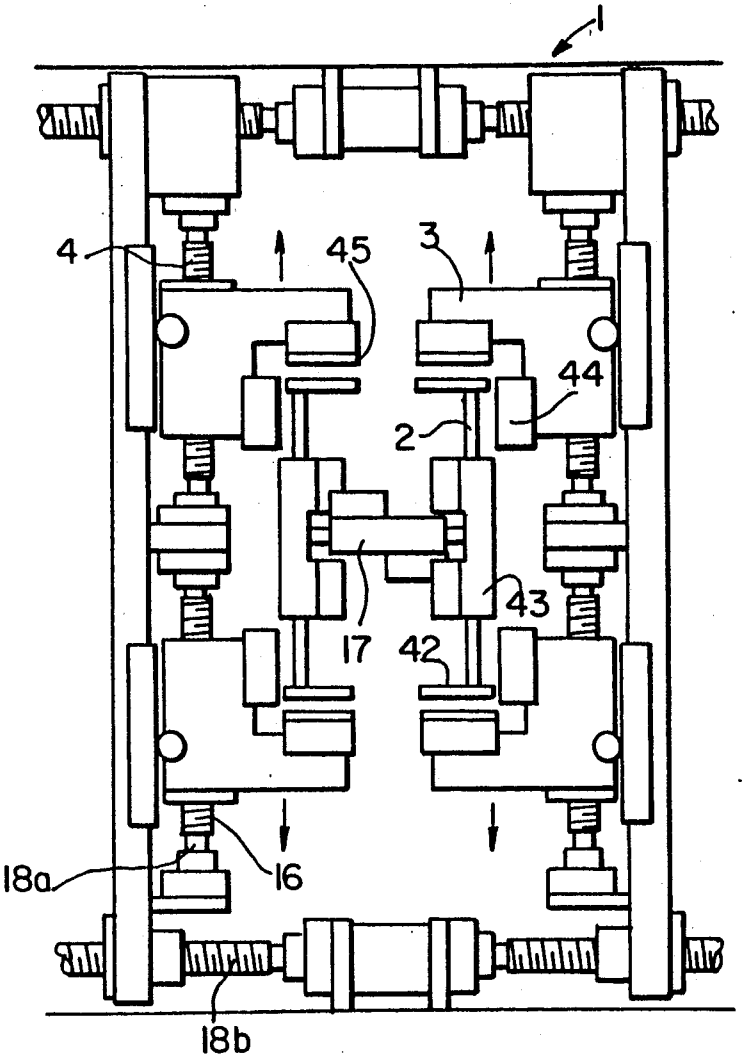
Figure 10C:
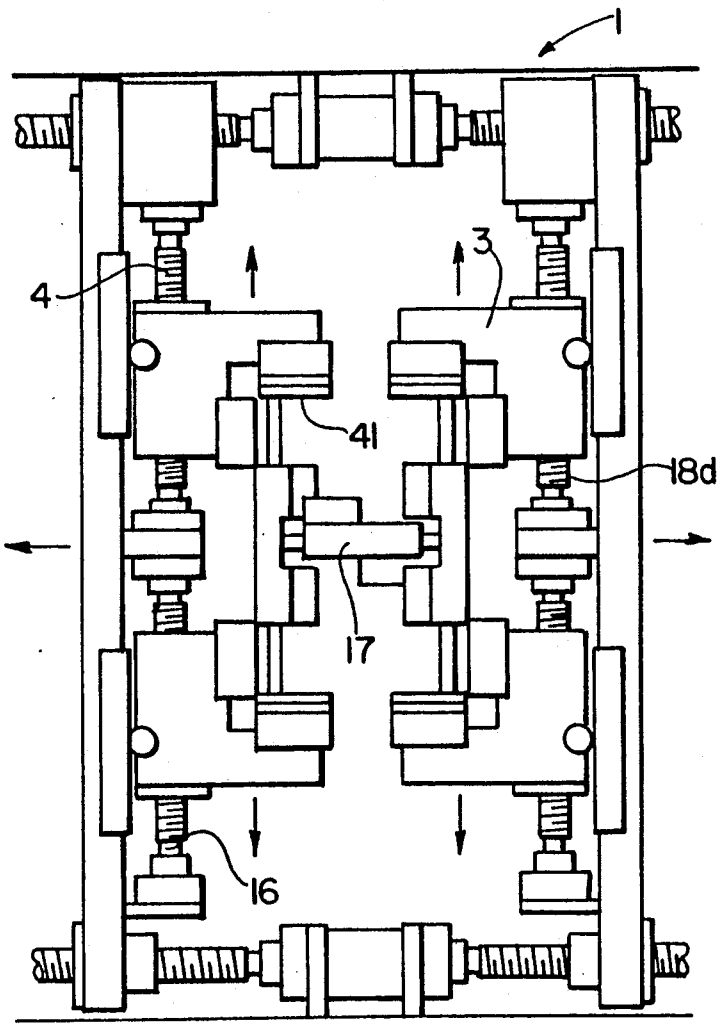

Subsequently, in an initial adjustment step (as shown in FIG. 10C), action is taken on only one of the two die-stamping members 2, 3, referred to as a driving adjustment member, to execute its position change, this driving adjustment member in turn acting directly on the other die-stamping member, referred to as the driven adjustment member, to ensure its position change in synchronism, until a first die-stamping member 2 and 3 is adjusted dimensionally.

Thereafter, the first die-stamping member 2 or 3 is locked. In a second adjustment step (shown in FIG. 10D), action is taken on only the second die-stamping member 2 or 3 to ensure its position change in the direction of a lateral spacing apart from the first die-stamping member 2 or 3, until the a preset space are reached, the second die-stamping member 2 or 3 then being adjusted dimensionally. The second die-stamping member is locked. And an engaging/disengaging shift of the die-stamping member 2 or 3 is executed to bring them into the stand-by position.

Consequently, the adjustment process includes a zero calibration step making it possible to reach a "zero point" corresponding to a marked relative position of the component parts of the stamp 2 and of the die 3, from which marked position the lateral shifts are executed and can be checked and recorded. In a first adjustment step, the dimensional adjustment of a first locking member is carried out. And for this purpose, positive action is taken to shift it on only one of the two die-stamping members 2, 3. In a subsequent second adjustment step, the final dimensional adjustment of the second die-stamping member is carried out to space it laterally apart from the first die-stamping member previously adjusted dimension-ally, to provide the necessary preset space between them.

These zero calibration, initial adjustment and second adjustment steps are carried out when the assembly 1 is engaged. The process therefore includes a subsequent step which causes assembly 1 to change to its disengaged state, thereby assuming the stand-by position.

As emerges from the foregoing, in the initial adjustment step one of the die-stamping members 2, 3 is used as a driving, that is to say positively shifted member, while the other die-stamping member is a driven member, that is to say its configuration or the relative positions of its components parts are determined by the configuration of the driving member only, without action being taken on the driven member. This results in simultaneous position changes of the two die-stamping members 2, 3. This same type of drive means using a driving member and a driven member is preferably employed in the zero calibration step. For this purpose, and to bring the two die-stamping members into the reference configuration, the following steps are executed from a stand-by position corresponding to a different blank format:

An engaging/disengaging shift of the two die-stamping members is executed to bring them into the engaged state, since the adjustment is made in this state. The two die-stamping members are unlocked.

Action is then taken on only one of the two die-stamping members, then designated as the driving zero calibration member, to ensure its position change, this driving zero calibration member first coming in contact with the other die-stamping member, referred to as a driven zero calibration member, and then in turn acting directly on the driven zero calibration member, to ensure its position change in synchronism up to the reference configuration (as shown in FIGS. 10A and 10B).

In a preferred embodiment corresponding to the particular case illustrated, the driving zero calibration member is the same as the driving adjustment member; the driven zero calibration member is the same as the driven adjustment member; the first die-stamping member is the same as the driven adjustment member; the second die-stamping member is the same as the driving adjustment member; the reference configuration is that of a format of extreme minimum dimension of both of the two die-stamping members; the respective position changes of the zero calibration step, and of the adjustment steps, are in opposite directions; the position changes of the zero calibration steps are shifts in the direction of contraction; the position changes of the adjustment steps are in the direction of expansion; the die is the driving adjustment member; and the stamp is the driven adjustment member.

However, the invention could be used in other alternative versions in which the driving zero calibration member is the driven adjustment member; the first die-stamping member is the driving adjustment member; the reference configuration is that of the maximum format or any other; the die is the driven adjustment member and the stamp the driving member.

In the preferred embodiment described, to ensure the position change of a driven die-stamping member using a driving die-stamping member, itself in a position change and the die-stamping members being engaged, either the driven member is urged into contact with the driving member in the same direction as that in which it is urged as a result of the shift of the driving member (in the initial adjustment step) or the driven member is left free (in the zero calibration step). Thus, taking the example of the adjustment step only, in the preferred embodiment the stamp 2 is urged in the direction of expansion, the stamp 2 thereby coming in contact with the die 3, and action is taken on the die 3 in the direction of expansion to bring the stamp 2 into the desired state after expansion.

To adjust the first die-stamping member dimensionally, during the initial adjustment step the position change of the first or second die-stamping member is executed over strokes equal to the difference between the desired final dimensions of the first die-stamping member and the initial dimensions of the reference configuration. This characteristic is such that it allows adjustment to be automatic and reproducible, the reference configuration being marked and the necessary shifting strokes being known as a function of the format to be produced.

To adjust the second die-stamping member dimensionally, at the moment of the second adjustment step the shift of the second die-stamping member is then executed over strokes equal to the a preset space. This characteristic likewise allows the adjustment to be automatic and reproducible, the lateral die-stamping spacings being known as a function of the thickness of the blank.

According to another characteristic of the adjustment process according to the invention, the initial dimensions of the reference configuration, the desired final dimensions of the first die-stamping member and the a preset space (or the thickness of the blank) are memorized, and action is taken on a driving member to ensure its position change, at the same time marking only the shifting stroke of this driving member, thus allowing the process to be automated.

A assembly 1 is such that the lateral means 4 for driving and blocking the two die-stamping members 2, 3 are shared by the two die-stamping members and comprise, bidirectional motorized thread drive 16 which is lockable in any position and coupled to and acting directly on one of the two die-stamping members, the driving adjustment member, and a single-direction actuator which is lockable in any position, coupled to and acting directly on the other die-stamping member, the driven member. Thus, when the single-direction actuator 17 is unlocked, they act on the driven adjustment member to urge it into contact with the driving member, the two die-stamping members 2, 3 then being engaged. Furthermore, the thread drive 16 can drive the driven adjustment member via the driving adjustment member.

The lockable thread drive 16 includes means for marking of the shifting stroke of the driving adjustment member, so that it is possible to check the shift, make it possible to obtain a desired dimension and ensure the reproducibility of the adjustment.

In the preferred embodiment, the lockable thread drive 16 includes at least one threaded rod 18, of which the pivoting in one direction or the other is ensured using at least one motor 19, an internally threaded hole 20 in the driving adjustment member interacting with the threaded rod 18.

Likewise, in a preferred, the lockable single-direction actuator 17 comprise at least one compressed-air jack acting on the driven adjustment member and a compressed-air supply coupled to the jack and capable of being cut off, with connection to ambient air. These lockable single-direction actuators 17 likewise comprise a positive locking member 22 acting on the driven member. This positive locking member is a locking head driven by a jack 23 acting on a rod 21*a* of the compressed-air jack 21. The compressed-air jack 21 is a single-acting jack, acting in the direction of expansion of the driven member.

In a preferred embodiment, the driven member comprises at least one rigid sleeve 24 forming a block, incorporating longitudinally at least one compressed-air jack 21, thus making it possible to guide a component part of the driven member at least. Also, the jack 23 for driving the locking member 22 is fastened transversely to the sleeve 24 in line with the compressed-air jack 21, orifices 25 for the supply of compressed air or for connection to ambient air for the jacks 21 and 23 likewise being provided in the sleeve 24.

When the jack 21 is connected to ambient air, the driven member may freely move.

In the preferred embodiment under consideration, the driving member is the die 3 and the driven member is the stamp 2. A preferred embodiment is now described in more detail. The driving adjustment member comprises four parts 26*a*, 26*b*, 26*c* , 26*d* carried by four separate supporting blocks 27. The lockable thread drive 16 comprises a first pair of parallel threaded rods 18*a*, each with two oppositely directed threads in the two end parts, interacting with suitable internally threaded holes 20 in the supporting blocks 27, this first pair of threaded rods 18*a* being carried by bearing blocks 28. The first pair of threaded rods 18*a* extends, for example, transversely, being set towards the outside of the parts 26*a* to 26*d*. There can be two bearing blocks 28, each comprising a beam 29 and bearing 30, the beam 29 extending in the transverse direction. The two bearing blocks 28 are likewise placed transversely, laterally and towards the outside of the assembly 1.

The lockable thread drive 16 includes a second pair of parallel threaded rods 18*b*, each having two oppositely directed end threads, interacting with suitable internally threaded holes 31 in the bearing blocks 28.

The motorized thread drive includes supporting bearings 32 for the second pair of threaded rods 18*b* which is carried by a frame 33 of the machine. The second pair of threaded rods 18*b* extends longitudinally, being set apart from the axis 15.

The drive 16 further includes two motors 19*a*, 19*b* carried by the frame 33 and acting on the threaded rods 18*a*, 18*b* respectively by two connection means 34*a*, 34*b* connecting the two motors 19*a*, 19*b* with the threaded rods 18*a*, 18*b*. The motor 19*a* can, for example, be carried by the frame 33 in the upper end position and, via chains or the equivalent 35, drive pinions or pulleys or the equivalent 36 carried by upper beams 37 of the frame 33. The pinions or the equivalent 36 can be connected using telescopic cardan shafts 38 to bevel-gear boxes 39, themselves located at the end of the two rods of the first pair of threaded rods 18*a*.

The motor 19*b* can be a geared brake motor carried by the frame 33 and driving a chain 40 or the equivalent arranged specially transversely, in direct engagement with the two threaded rods of the second pair of threaded rods 18*b*.

The bidirectional motorized thread drive 16 further include means for controlling the motors 19*a*, 19*b*, including means for marking and memorizing the number of revolutions or portions of revolutions executed by the threaded rods of the two pairs 18*a*, 18*b*, so that it is possible to mark the relative position of the component parts of the die 3.

As emerges from the foregoing, the two pairs of threaded rods 18*a*, 18*b* are arranged longitudinally (in this particular case, as regards the second pair of threaded rods 18*b*) and transversely (as regards the first pair 18*a*). These threaded rods are placed towards the outside of the component parts of the die 3. Finally, these threaded rods form between them a substantial free spacing-apart space, in which the component parts of the die 3 are arranged at the desired locations, these locations being variable as a function of the dimensional adjustment of the die 3.

The driven member is now described in more detail in the preferred embodiment under consideration. The driven member four plural parts 41*a* to 41*d* forming two pairs supported by two outer sleeves 24*a* using the rods 21*a* of first compressed-air jacks 21. These two outer sleeves 24*a* are carried by a central sleeve 24*b* using the rods 21*a* of second compressed-air jacks 21.

The lockable single-direction actuator 17 includes at least four first compressed-air jacks 21 arranged in parallel, one for each part of the driven member and two in opposite directions on each outer sleeve 24*a*.

Single-direction actuator with locking 17 further include at least two second compressed-air jacks 21 arranged parallel and perpendicularly to the first jacks, one for each outer sleeve 24*a* and the opposite two on the central sleeve 24*b*.

Four first locking jacks 23 are carried by the outer sleeves 24*a* and act on the first compressed-air jacks 21 carried by these outer sleeves 24*a*.

The actuators 17 likewise include two second locking jacks 23 carried by the central sleeve 24*b* and acting on the second compressed-air jacks 21 carried by the central sleeve 24*b*.

The actuators 17 further include the orifices 25 for the supply of compressed air and for connection to ambient air on the two outer sleeves and the central sleeve 24*a*, 24*b*, for feeding the jacks 21, 23, consequently in communication with the first and second compressed-air jacks 21 and with the first and second locking jacks 23, on one side, these orifices 25 being in communication, on the other side, with compressed-air supplies which can be cut off.

The compressed-air supplies can be cut off, with connection of the chambers of the jacks 21, 23 to ambient air, so that the jack rods are then free.

Preferably, each first or second compressed-air jack 21 is double, the two jacks composing it being in the immediate vicinity of one another, and coupled to them is a single locking jack 23 acting on the two jack rods 21*a*.

This arrangement makes it possible for the jack rods 21*a* to ensure the slideable retention of the outer sleeves 24*a* and of the component parts 41*a*, 41*b*, 41*c*, 41*d* of the driven member. When the driven member is the stamp, these component parts 41*a*, 41*b*, 41*c*, 41*d* are plates extending over a certain axial length along the axis 15 and over a certain length in the lateral direction. The sleeves 24*a*, 24*b* are composed of blocks of, for example, general parallelepipedic form, likewise extending along the axis 15. In this embodiment, the double jacks forming each first or second compressed-air jack 21 are superposed in the same vertical plane. Furthermore, the outer vertical edges 42 of the component parts 41*a*, 41*b*, 41*c*, 41*d* are projecting and preferably coplanar relative to the outer faces 43 of the adjacent outer sleeves 24*a*, and these outer faces 43 can thus contribute to the die-stamping operation.

Figure 8:
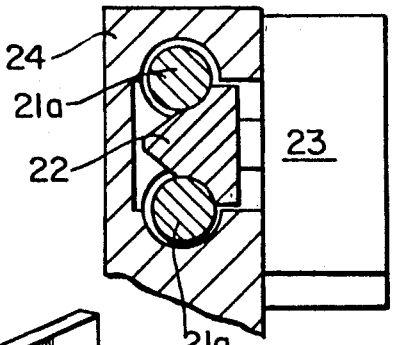
FIG. 7 and FIG. 8 are two partial diagrammatic views in section along the lines 7—7 and 8—8 of FIG. 6, illustrating details of the stamp of the die-stamping machine.
Figure 6:
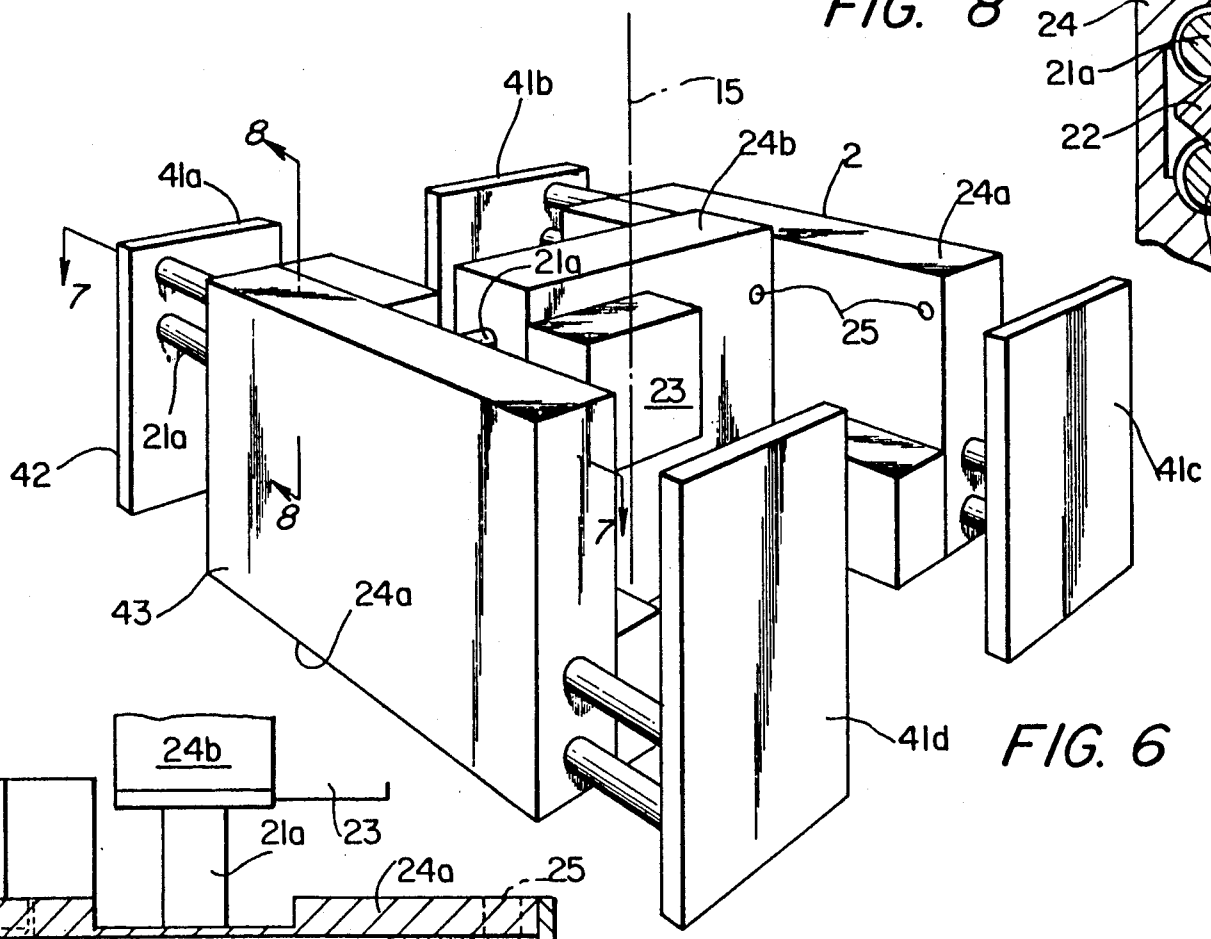
FIG. 6 is a perspective view of the stamp of the die-stamping assembly.
Figure 7:
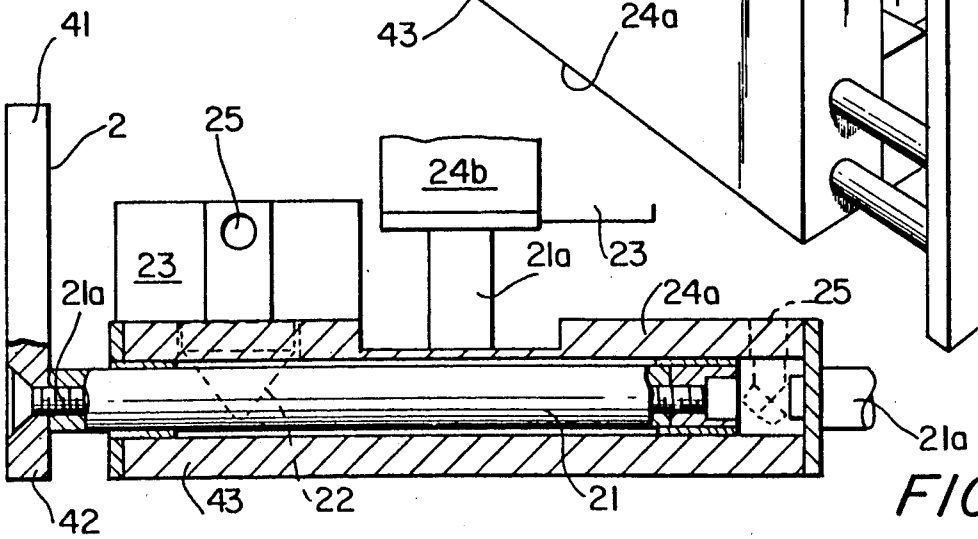
Figure 9:
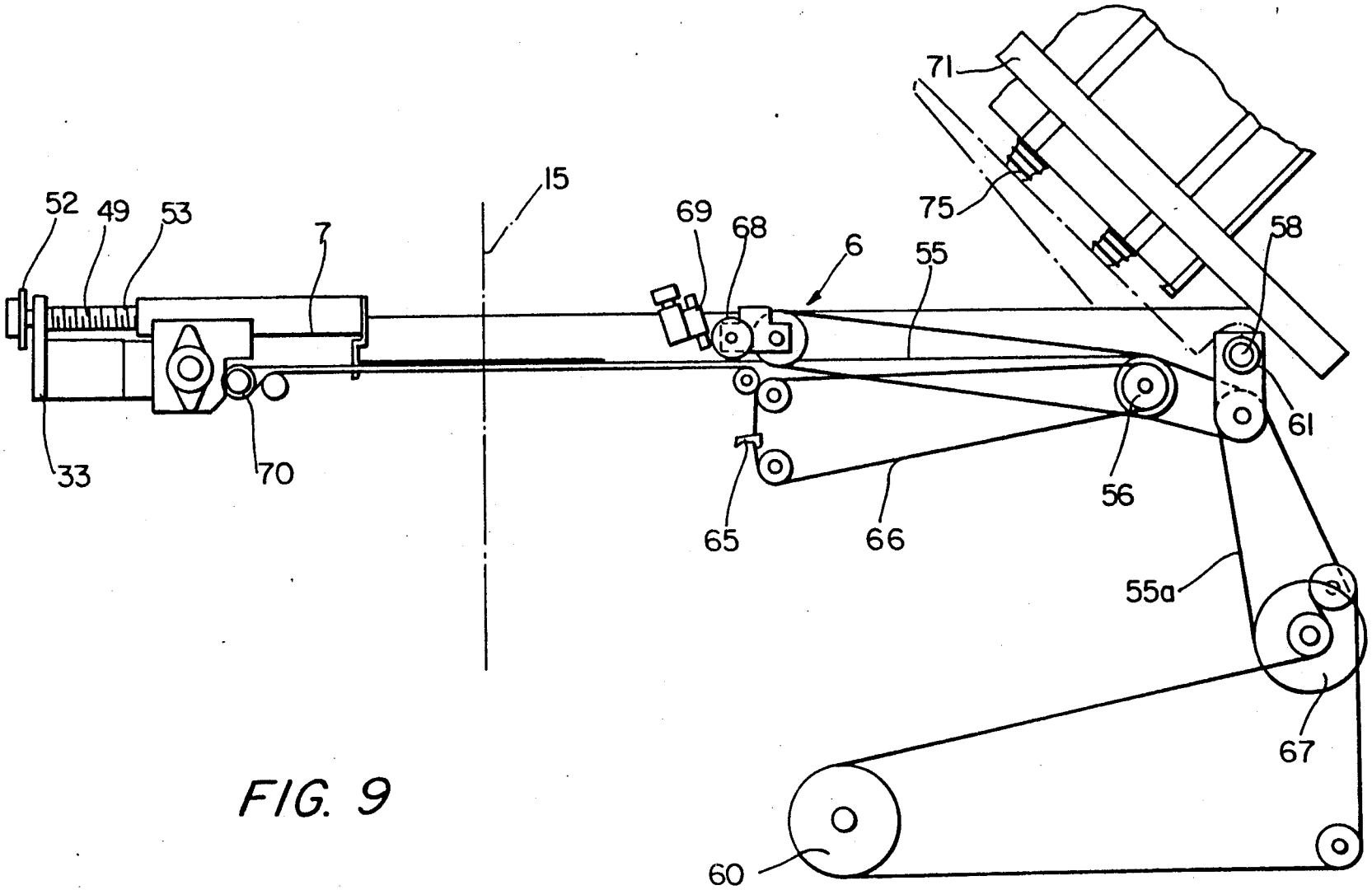
FIG. 9 is a diagrammatic view of the blank supply means and of the longitudinal abutment means of the die-stamping machine according to the invention.

In a preferred embodiment (shown in FIG. 8), the locking head 22 is tapered at its outer engaging end directed towards the rods 21*a* and bulges at its rear end directed towards the jack 23, while being covered at least on the outside with a flexible and/or non-slip material.

Details of the die 3 itself can take the form of different embodiments.

Preferably, each of the parts 26*a*, 26*b*, 26*c*, 26*d* has a sheet 44 for folding the flap of the blank D, carried fixedly by the supporting block 27, and a presser 45 mounted slideably on the supporting block 27 using a jack 46. The folding sheet 44 and the presser 45 are arranged in two planes perpendicular, so as to form a reentry angle of the die 3. For example, the folding sheets 44 are arranged in vertical and transverse planes, while the pressers 45 are arranged in longitudinal planes. In this position, the folding sheets 44 are suitable for the folding of the transverse flaps 12, while the pressers 45 are suitable for the folding of the longitudinal flaps 11.

The pressers 45 have a slight sliding stroke. The pressers 45 are therefore movable between two end positions. A retracted inactive position, in which they are furthest apart, and a projecting active position, in which they are nearest. The retracted inactive position is that occurring at the start of die-stamping and allows the presence, during die-stamping, of a blank D, the flaps 11 and tabs 13 of which are not yet fixed together by ahesive bonding. In this retracted position the pressers 45 are in a configuration slightly larger than the final configuration of the blank. The active position of the pressers corresponds exactly to the die-stamping position, with the exact dimensions of the blank. The flaps 11 are then laid against the tabs 13.

The die 3 can likewise possess longitudinally arranged plates 47 for the prefolding of the tabs 13 and likewise longitudinally arranged curved sheets 48 for the folding of the flaps. The plates 47 and the sheets 48 being located in the upper end part of the die 3 on the same side as the insertion of the stamp 2, while, the folding sheets 44 and the pressers 45 are located in the lower part, the folding sheets 44 nevertheless extending up to the upper part of the die 3.

The die-stamping sequence is known in the prior art. Since the blank D to be die-stamped is planar and horizontal, a start is made by first carrying out a prefolding of the longitudinally arranged tabs 13 using the plates 47. Then, the folding of the longitudinal flaps 11 is carried out using the sheet 45, and simultaneously the transverse flaps 12 are folded using the sheets 44. The pressers 45 are up to then in the inactive state. They are then brought into the active state so that the longitudinal flaps 11 are laid against the tabs 13, the previously deposited strips of glue 14 ensuring that the assembly is joined together.

A die-stamping machine, the general structure of which has already been described, incorporates such a die- assembly 1.

According to one characteristic of this machine, the means forming a longitudinal abutment 7 are shiftable longitudinally and lockable in any position by driving and locking means 49, these driving and locking means 49 being controlled as a function of the format of the blank, such that the latter is wedged on the axis 15 of the die-stamping assembly 1. The driving and locking means 49 comprise, for example, a geared brake motor 50 carried by the frame 33 and driving an endless chain or the equivalent 51 engaged on a pinion 52 keyed on a threaded rod 53 mounted on a fixed nut 54 and also carrying the actual abutment.

The blank supply means 6 comprise two endless continuously traveling lateral and longitudinal belts 55 stretched between end drums 56 carried by two lateral and longitudinal supporting beams 57, themselves carried by the frame 33 so as to be transversely adjustable, but lockable in any position by drive means 58 controlled as a function of the transverse format of the blank. The endless belts 55 likewise extend downstream (in relation to the direction of delivery of the blanks D) vertically in line with the die-stamping assembly 1, transversely on the outside of the latter, in a plane slightly above the die 2. The endless belts 55 allow the relative sliding on them of the blank D in the die-stamping position, said blank being locked by the means forming an abutment and being urged towards them by the moving endless belts 55.

A geared motor 59 located in a lower position on the frame 33 drives a transverse shaft 60 which, by suitable connection means **55*a*, such as endless chains or straps, drive the drums 56 and therefore the endless belts 55**.

The drive means 58 comprise transverse threaded rods having oppositely directed threads 61 carried by bearings 62 of the frame which are driven in one direction or the other from a geared motor 63, likewise carried by the frame 33, using a chain or the equivalent 64.

The blank supply means 6 likewise comprise at least one dog 65 for the positive drive of the blanks D. If appropriate, there are several dogs arranged at a uniform distance in the longitudinal direction. Likewise, a pair or several pairs of dogs 65 arranged at a transverse distance are preferably provided. These dogs 65 are placed between the endless belts 55 in the upstream direction. They are driven in synchronism with the endless belts 55 by drive means 66 connected to the geared motor 59 and to the shaft 60 using a transmission 67 shared by the connection means **55*a*. The dogs 65 make it possible to drive the blanks D by pushing them via their upstream (or rear) transverse edge. The effect of the dogs 65 is to prevent the inopportune sliding of a blank on the endless belts 55. Such a position could occur where a light-weight blank is concerned. Such a position risks arising all the more because, according to the invention, the endless belts 55 must allow the blank to slide in the zone of the assembly 1, the endless belts 55** traveling along while the blank remains stationary.

More specifically, a dog 65 slides downstream towards the middle part of the endless belts 55, and there is a backup roller 68 ensuring a positive drive of the blank and driven in synchronism with the endless belt placed opposite by driving and/or transmission and/or connection means coupled to the means **55*a* and 67. The effect of the roller 68 is to take over the positive drive of a blank when the dog 65 has moved back into its downstream end position. As a result, the shift of the blank D in synchronism with the endless belts 55 is ensured, thus making it possible to mark the exact position of the moving blank D. Arranged near the roller 68 are means for detecting the blank passing in line with the roller 68, such as a photoelectric cell. Still in the vicinity, there are also means 69 for coating with glue the lateral and longitudinal flaps 11 of the blank. These conventional glue-coating means 69 are controlled from a coder 70 coupled to the drive of the endless belts 55 or of the backup roller 68. The coder 70 takes the form of a roll coupled to one of the end drums of the endless belts 55. The effect of this arrangement is that, according to the longitudinal format of a blank to be die-stamped, a certain glue-coating program corresponds and activates the glue-coating means 69 when the blank reaches the required position on the endless belts 55. The glue-coating program involves determining the lengths of the strips of glue 14 and their position on the longitudinal flaps 11**.

According to another characteristic, the blank supply means 6 comprise at least one magazine 71 of blanks stacked in line with and above the endless belts 55, upstream, with a lower extraction orifice 72 and with an upper loading orifice 73. The magazine 71 is designed for receiving blanks of different formats. Coupled to the magazine 71 are means 74 for extracting the blank appearing in the extraction orifice 72, such as suction cups 75 with controlled functioning and shifting and, carried by an arm 76 mounted pivotally about a transverse axle 77 driven to pivot from the geared motor 59 and the shaft 60 via a transmission 78.

In a preferred, there is a single magazine 71 inclined from upstream in the downstream direction and from the bottom upwards and limited by a fixed upstream crosspiece 79 or any equivalent member and two longitudinal and lateral spars 80 or the equivalent, carried by the supporting beams 57 of the endless belts 55. The cross-piece 69 and the spars 80 are of a length suitable for making it possible to store blanks of the maximum format and minimum format and of any intermediate format.

In another embodiment, there are several magazines 71 for holding blanks of different formats and means making it possible to use only the magazine corresponding to the desired format.

As already emerges from the foregoing, the die 3 is, in a general stationary position slightly below the horizontal plane of the endless belts 55, while the stamp 2 is mounted so as to be vertically slideable along the axis 15 above the die 3, being driven by the axial driving and locking means 5. Such axial driving and locking means 5 can comprise one or more vertical guides 81, on which are mounted slides 82 forming brackets and supporting the horizontal and transverse stamp-holder beam 83, to which is fastened rigidly a stamp-holder 84 of axis 15 vertically and axially, terminating in its lower part in the central sleeve **24*b*. The slide 82 is driven vertically upwards or downwards by the geared motor 59 and the shaft 60 using a suitable transmission 85**.

The extraction and discharge means 8 comprise, members 86 for the temporary locking of a blank die-stamped in the die, which are active at the moment of die-stamping, during pressing by the pressers 45 and when the stamp 2 is made to slide vertically upwards to release it from the die 3 after die-stamping, that the die-stamped blank remains temporarily in the die 3 in a fixed, predetermined and constant position, without being driven by the moving stamp 2. These temporary locking members 86 are, for example, suction cups carried by the pressers 45 and associated with a suitable vacuum supply.

Moreover, the extraction and discharge means 8 comprise, in the second place, movable grasping members 87 arranged underneath the die 3 and designed to grasp and transport a die-stamped blank from below on the bottom 10, when the temporary locking members 86 have become inactive, to transferring the die-stamped blank onto a conveyor 88.

The grasping members 87 are, for example, suction cups coupled to a vacuum supply and carried by supporting means 89 ensuring that they are shifted especially axially along the axis 15 and connected using a transmission 90 to the geared motor 59 or to the shaft 60 or to any other suitable motor. The conveyor 88 is, for example, a conveyor arranged transversely underneath the die 3.

The adjustment process is now described, this making use, in general, of a programmable automatic control making it possible to control the adjustments of the various components and members of the machine, including the assembly 1, according to the dimensional characteristics of the blanks to be produced. Thus, as a function of a particular blank to be produced, the appropriate magazine 71 must be adapted or selected and, likewise, the transverse spacing of the belts 55 must be adapted. The spacing of the endless belts 55 is obtained by drive means 58. A blank is extracted from the magazine 71 via the lower extraction orifice 72 using the suction cups 75 driven by the arm 76. The blank is deposited on the endless belts 55, the transverse spacing of which has thus been previously adjusted. The endless belts 55 combined with the dog 65 drive the blank up to the roller 68. The roller 68 pinches the blank against the endless belt 55, so as to ensure its positive synchronous shifting with the endless belts 55 and, as explained, the marking of the blank. Using the program and the data of the programmable automatic control, the longitudinal flaps 11 are coated with glue by the glue-coating means 69 during the passage of the blank to be die-stamped. In parallel, the longitudinal abutment 7 has been adjusted and the stamp 2 is in the stand-by position. The blank thus arrives between the die 3 and the stamp 2 in the exact die-stamping position determined by the longitudinal abutment 7. It is then possible, using a geared motor 59, to ensure the vertical downward movement of the stamp 2 into the die 3, thereby carrying out the die-stamping of the blank. The suction cups 86 are activated together with the pressers 45. The stamp 2 can be released, while at the same time the suction cups 87 can grasp the die-stamped blank and deliver it onto the conveyor 88. When a dimensional adjustment of the die-stamping assembly is necessary, the following operations are carried out, in the absence of any blank between the stamp 2 and the die 3:

an engaging/disengaging shift of the stamp 2 and of the die 3 is executed to bring them into the engaged state. The stamp 2 and the die 3 are unlocked. Action is subsequently taken on the jacks 46 to cause the pressers 45 to assume the active position, this position being the only one to take into account to define the die-stamping dimensions of the die 3.

Thereafter, action is taken on the die 3 in the direction of its contraction to ensure its position change to the minimum reference dimension corresponding to the format of minimum dimension with the stamp still being free to move, the jacks 21 not preventing its movement in the direction of contraction. From this minimum reference dimension of the die action is subsequently taken on the die 3 in the direction of its expansion, and simultaneously the stamp 2 is urged in the direction of its expansion into contact with the die 3 up to the suitable dimension of the stamp 2. The stamp 2 is then brought into the state locked in its appropriate dimension. Action is continued on the die 3 in the direction of its expansion, to move it laterally apart from the stamp by the amount of the desired a preset space, up to the appropriate dimension of the die 3. The die 3 is then brought into the state locked in its appropriate dimension, and an engaging/disengaging shift of the stamp 2 and of the die 3 is executed to bring them into the stand-by position. In this stand-by position, it is possible to contemplate the die-stamping of a suitable blank. The pressers 45 are returned to the inactive position beforehand using the jacks 46.

I claim:

1. Apparatus for die-stamping cardboard blanks, including a supporting framework, first and second die-stamping means for die-stamping blanks of pieces of cardboard for forming into trays, said first die-stamping means being mounted in said supporting framework and including a first tray-forming part having a selectively adjustable and lockable configuration, said second die-stamping means being slidably mounted in said supporting framework in axial alignment with said first die-stamping means and including a second tray-forming part having a selectively adjustable and lockable configuration, one of said first and second tray-forming parts being a driving part and the other of said first and second tray-forming parts being a driven part, the configuration of said driven part being determined by the action of said driving part, selectively lockable single-direction actuator means coupled to and acting on said driven part for urging said driven part into contact with said driving part when said actuator means is unlocked, and selectively lockable bi-directional drive means coupled to and acting on said driving part for adjusting the configurations of said driving and driven parts.

2. The apparatus of claim 1, wherein said first die-stamping means is a die and said second die-stamping means is a stamp.

3. The apparatus of claim 2, wherein said driving member is said first tray-forming part and said driven member is said second tray-forming part.

4. The apparatus of claim 1, wherein said single-direction actuator means comprises at least one compressed-air jack and said bi-directional drive means comprises a motor and at least one threaded rod rotatably coupled to said motor.

5. Apparatus for die-stamping cardboard blanks, including a supporting framework, first and second die-stamping means for die-stamping blanks of pieces of cardboard for forming into trays, said first die-stamping means being mounted in said supporting framework and including a first tray-forming part having a selectively adjustable and lockable configuration, said second die-stamping means being slidably mounted in said supporting framework in axial alignment with said first die-stamping means and including a second tray-forming part having a selectively adjustable and lockable configuration, at least one selectively lockable compressed-air jack coupled to and acting on said second tray-forming part for urging said second tray-forming part into contact with said first tray-forming part when said compressed-air jack is unlocked, and at least one motor and at least one selectively lockable threaded rod, said threaded rod having a first end rotatably coupled to said motor and a second end coupled to and acting on said first tray-forming part for adjusting the configurations of said first and second tray-forming parts.

* * * * *